US006460990B2

(12) United States Patent
Yraceburu et al.

(10) Patent No.: US 6,460,990 B2
(45) Date of Patent: Oct. 8, 2002

(54) NON-WARPING HEATED PLATEN

(75) Inventors: Robert M. Yraceburu, Camas, WA (US); Michel A. Riou, Milwaukie, OR (US); Robert J. Reichert, Camas; Geoff Wotton, Battle Ground, both of WA (US)

(73) Assignee: Hewlett-Packard Co., Palo Alto, CA (US)

( * ) Notice: Subject to any disclaimer, the term of this patent is extended or adjusted under 35 U.S.C. 154(b) by 0 days.

(21) Appl. No.: 09/728,049

(22) Filed: Dec. 1, 2000

(65) Prior Publication Data

US 2002/0067401 A1 Jun. 6, 2002

(51) Int. Cl.[7] ..... B41J 2/01

(52) U.S. Cl. ..... 347/102

(58) Field of Search ..... 347/101, 102, 347/103; 399/320; 346/25; 219/216; 101/488; 34/304, 381, 254

(56) References Cited

U.S. PATENT DOCUMENTS

| | | | | |
|---|---|---|---|---|
| 4,264,293 | A | * | 4/1981 | Rourke |
| 4,269,586 | A | * | 5/1981 | Ronayne |
| 4,751,528 | A | * | 6/1988 | Spehrley, Jr. et al. |
| 5,023,111 | A | * | 6/1991 | Fulton et al. |
| 5,037,079 | A | * | 8/1991 | Siegel et al. |
| 5,105,204 | A | * | 4/1992 | Hoisington et al. |
| 5,114,747 | A | * | 5/1992 | Fulton et al. |
| 5,504,562 | A | * | 4/1996 | Velasques |
| 5,510,822 | A | * | 4/1996 | Vincent et al. |
| 5,668,584 | A | * | 9/1997 | Broder et al. |
| 5,980,981 | A | * | 11/1999 | Fulton et al. |

OTHER PUBLICATIONS

US 5,821,442, 10/1998, Fulton et al. (withdrawn)*

* cited by examiner

*Primary Examiner*—Raquel Yvette Gordon

(57) ABSTRACT

A non-warping heated platen uses tight controls in the axial direction between a planar heater used to heat print media passing thereacross and a rigid planar base to which it is coupled. A plurality of embodiments are described for coupling the heater and base.

21 Claims, 6 Drawing Sheets

NON-WARPING HEATED PLATEN

BACKGROUND OF THE INVENTION

1. Field of the Invention

The present invention relates generally to hard copy apparatus, more specifically to an ink-jet printer employing a heated, planar platen, and particularly to non-warping heated platen assemblies.

2. Description of the Related Art

A variety of hard copy printing technologies—for example impact, thermal, laser, ink-jet—are commercially available. In order to describe the present invention, exemplary embodiments in the form of ink-jet printers are depicted. No limitation on the scope of the invention is intended by the use of such exemplary embodiments nor should any be implied therefrom. The art of ink-jet technology is relatively well developed. Commercial products such as computer printers, graphics plotters, copiers, and facsimile machines employ ink-jet technology for producing hard copy. The basics of this technology are disclosed, for example, in various articles in the *Hewlett-Packard Journal,* Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No. 1 (February 1994) editions. Ink-jet devices are also described by W. J. Lloyd and H. T. Taub in *Output Hardcopy* [sic] *Devices,* chapter 13 (Ed. R. C. Durbeck and S. Sherr, Academic Press, San Diego, 1988).

FIGS. 1A and 1B depict an ink-jet hard copy apparatus in which the present invention is useful; in this exemplary embodiment, an engine for computer printer 101 employing a media vacuum transport is illustrated. In general, the carriage scanning axis is designated the x-axis, the print media transport axis is designated the y-axis, and the pen firing direction onto the media is designated the z-axis. Operation is administrated by an electronic controller (not shown; usually a microprocessor or application specific integrated circuit ("ASIC") printed circuit board). It is well known to program and execute imaging, printing, print media handling, control functions and logic with firmware or software instructions using such a controller.

Paper sheets 22 from an input supply (not shown) are sequentially captured and fed by a vacuum belt mechanism to an internal printing station, or "print(ing) zone," 28. A thin, endless-loop belt 26 is mounted tightly between belt drive rollers 62, 64. Drive roller 62 is coupled to a stepper device (not shown ) for accurately positioning the sheet in the y-axis with respect to the pen 20. A vacuum box 40, coupled by an appropriate conduit 48 to a vacuum source 50 (FIG. 1B only) has a platen 42 having a plurality of vacuum ports 44 (FIG. 1B only) therethrough. The belt 26 is generally porous, allowing a vacuum flow to pull through the belt via the ports 44. The paper sheet 22 is captured in an upstream (with respect to the pen 20 and associated print zone 28) support zone 55 by the vacuum force exerted thereon as the sheet is received from the input supply and its associated pick mechanisms (not shown). In another upstream, pre-print zone 51, the sheet can be engaged by a controlled pinch roller 53 device. In the print zone 28, one or more ink-jet pens 20, mounted on an encoder controlled scanning carriage (not shown), scan the adjacently positioned paper sheet 22 and graphical images or alphanumeric text are created. Each pen 20 has one or more printhead mechanisms (not seen in these views) for "jetting" minute droplets of ink to form dots on the adjacently positioned sheet 22 of print media. Each minute droplet is directed at an artificially imposed row and column grid on the print media known as a picture element ("pixel") using digital dot matrix manipulation to form alphanumeric characters or graphical images. Once a printed page is completed, the print medium is ejected from the belt 26.

For ink-jet printing, it is desirable to maintain a relatively minute, close tolerance, printhead-to-media spacing (z-axis) in order to maximize the accuracy of ink drop placement for optimized print quality. One factor for design optimization is platen flatness. In the state of the art, it is desirable to have a printhead-to-media spacing of less than about one millimeter ("mm"). If the platen 42 (or belt 26 riding across the surface thereof) is too close to the printheads at any region of the printing zone 28 or immediately adjacent thereto where pen-to-paper might interfere, smudging of wet ink or damaging pen-media crashes can occur.

To improve ink-jet apparatus performance (ink-media interaction, dry time, print quality, throughput, and the like as would be known to practitioners of the art), it is often advantageous to heat the platen 42. FIG. 2 is an exemplary embodiment of a vacuum belt subsystem 200, including a specific embodiment of a heated platen 42 in accordance with the present invention. A transport portion, or region, 66 of the belt 26 slides over a support surface 52 of the vacuum platen 42, having ports 44 arranged for communicating vacuum pressure to the surface 52. Paper sheets 22 are sequentially directed onto the transport portion 66 by known manner paper supply pick and feed mechanisms (not shown). Conductive heating of the belt 26 is accomplished by the use of one or more heaters 70 that are about 1-millimeter below the platen support surface 52, in this embodiment, fabricated of a ceramic material for conducting the applied heat. The heaters 70 are comprised of an array of printed, linear, resistive heating elements 72. The individual heating elements 72 extend between the rows of vacuum ports 44 that are defined on the support surface 52 of the platen 42. At the edges of the support surface 52, the individual elements 72 are joined (as at reference numeral 74) and the termini of the heaters are enlarged into two contact pads 76 for connecting to a known manner source of electrical potential. The heaters 70 are arranged so that one heater resides on the central portion of the platen 42 immediately in the print zone 28. There are also two heaters 70 in the platen 42 entry region 130, referred to as "entry region heaters," viz. a pre-printing operations region. Similarly, two "exit region heaters" are provided at the exit region 132 of the platen, viz. A post-printing operations region. Further details of this specific embodiment are described in CONDUCTIVE HEATING OF PRINT MEDIA is described by common inventor Wotton et al., in U.S. patent application Ser. No. 09/412,842, filed Oct. 5, 1999 (assigned to the common assignee herein); however, details other than those incorporated herein are not required in order to understand the present invention.

Under normal operating conditions, the platen 42 may experience temperatures in the approximate exemplary range of zero to 150° Centigrade (it will be recognized to those skilled in the art that the actual range will be dependent upon the specific implementation). Such temperature excursions, temperature transients, and cross-platen gradients can cause a platen 42 to warp.

Previous solutions include employing long warm-up time, the use of high cost materials, or providing high power controls (e.g., using 220 volt circuits), and the like to resolve the problems. However, long cool-down times may still need to be employed to ensure flatness is kept within predetermined tolerances.

Therefore, there is a need for methods and apparatus that comprise non-warping heated platen.

SUMMARY OF THE INVENTION

In its basic aspects, the present invention provides a heated platen apparatus, having a media transport surface, including: a planar heater, forming said surface and having a predetermined thickness "t"; a planar base, having a predetermined thickness "T," substantially greater than "t," and having a low coefficient of thermal expansion; and an attachment conjoining said heater and said base, wherein the attachment provides a high thermal resistance and said surface remains planar regardless of temperature changes of said heater.

In another aspect, the present invention provides a hard copy apparatus, having a means for transporting media through a printing zone, including: a heated, planar, media platen located at least partially within said printing zone, having a planar platen member having a media heating surface, a rigid, planar base, and an attachment for coupling the platen member to the planar base, wherein the base is thermally conductive and relatively thicker than the platen member such that the base heats-up uniformly and does not warp itself to any effective degree due to varying thermal expansions and contractions of the platen member and thereby maintains planarity of the platen member.

In another aspect, the present invention provides a method for maintaining planarity of a heated platen assembly of a printing apparatus, including the steps of: providing a heated platen, an attaching member, and a rigid base; fabricating an attaching member having operational characteristics of the attaching member to ensure flatness of the heated platen by requiring that only a small thermal mass must be heated before printing can begin; and coupling the platen and the base via the attaching member.

Some advantages of the present invention are:

- it provides a flat, heated platen over a large temperature range;
- it provides a flat, heated platen despite various temperature gradients across the platen;
- it provides a flat, heated platen despite rapid temperature transients, e.g., during warm-up and cool-down cycles;
- it allows short warm-up times;
- it allows rapid cool-down times;
- it allows the use of smaller power supplies; and
- it allows the heater assembly and platen base to have different coefficients of thermal expansion.

The foregoing summary and list of advantages is not intended by the inventors to be an inclusive list of all the aspects, objects, advantages, or features of the present invention nor should any limitation on the scope of the invention be implied therefrom. This Summary is provided in accordance with the mandate of 37 C.F.R. 1.73 and M.P.E.P. 608.01 (d) merely to apprise the public, and more especially those interested in the particular art to which the invention relates, of the basic nature of the invention in order to be of assistance in aiding ready understanding of the patent in future searches. Other aspects, objects, advantages, and features of specific embodiments of the present invention will become apparent upon consideration of the following explanation and the accompanying drawings, in which like reference designations represent like features throughout the drawings.

BRIEF DESCRIPTION OF THE DRAWINGS

FIGS. 1A and 1B depict an exemplary ink-jet hard copy apparatus engine in accordance with the present invention in which:

FIG. 1A is a schematic perspective view, and

FIG. 1B is a partially cut-away, elevation view.

DESCRIPTION OF THE PRESENT INVENTION

Reference is made now in detail to a specific embodiment of the present invention that illustrates the best mode presently contemplated by the inventors for practicing the invention. Alternative embodiments are also briefly described as applicable.

For the purpose of this detailed description, "flat" ("flatness") is defined as remaining planar within a tolerance of 100 um over a print zone area of about one-inch (y-axis) by thirteen inches (x-axis) and 150 um over a platen surface area of about twelve-inches by thirteen inches when the platen is heated over its operational range, e.g., a range of approximately zero degrees Centigrade (0° C.) to one-hundred fifty degrees Centigrade (150° C.), regardless of instantaneous temperature profiles across the platen during operation and rapid temperature transients when the platen is warming up and cooling down. This definition is based on current ink-jet pen drop deposition capabilities, specific ink formulations, and the like factors for operation of a specific implementation. It should be recognized by those skilled in the art that such definition can change with changes and advances in the ink-jet printing field of technology. Other implementations may have a different operating range (e.g., a volatile ink formulation may need on one-hundred degrees for an adequate rapid drying). Thus, this definition is not intended by the inventors as a limitation on the scope of the invention nor should any such intent be implied.

The invention provides the necessary operational characteristics to ensure flatness of the heated platen 42 by requiring that only a small thermal mass must be heated before printing can begin.

Figure 1A:
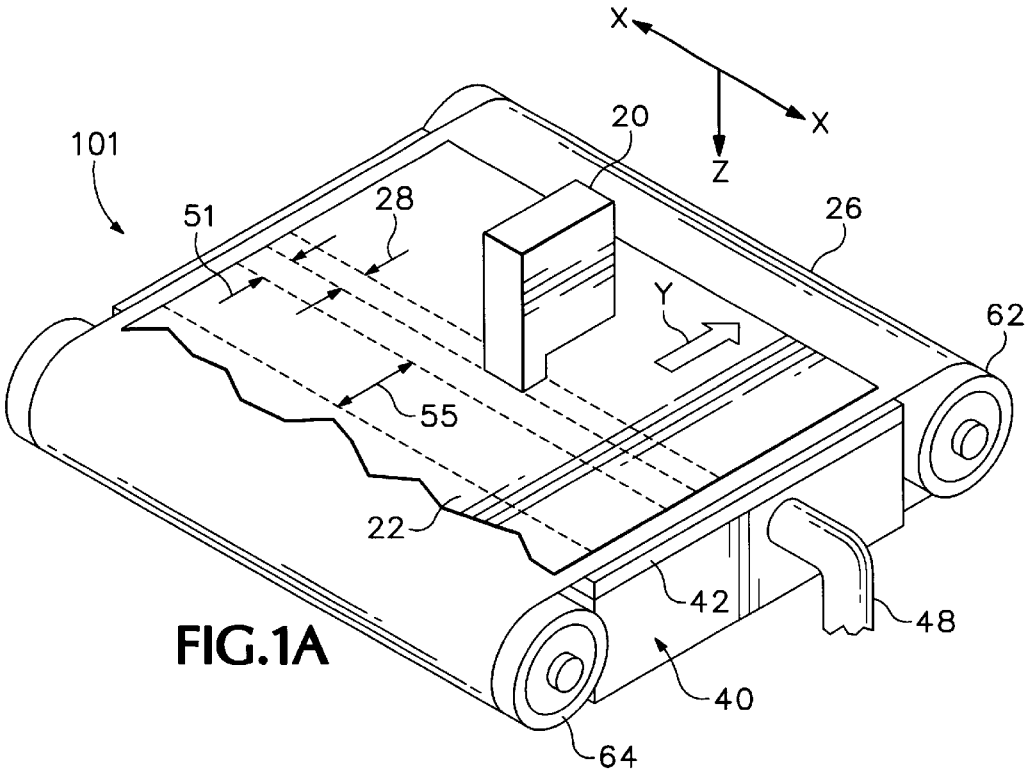
Figure 1B:
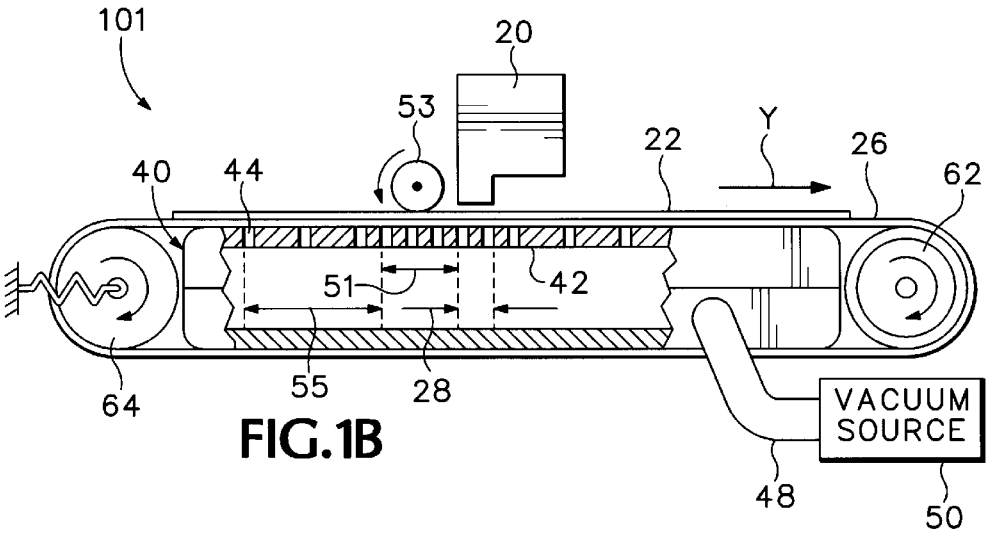
Figure 2:
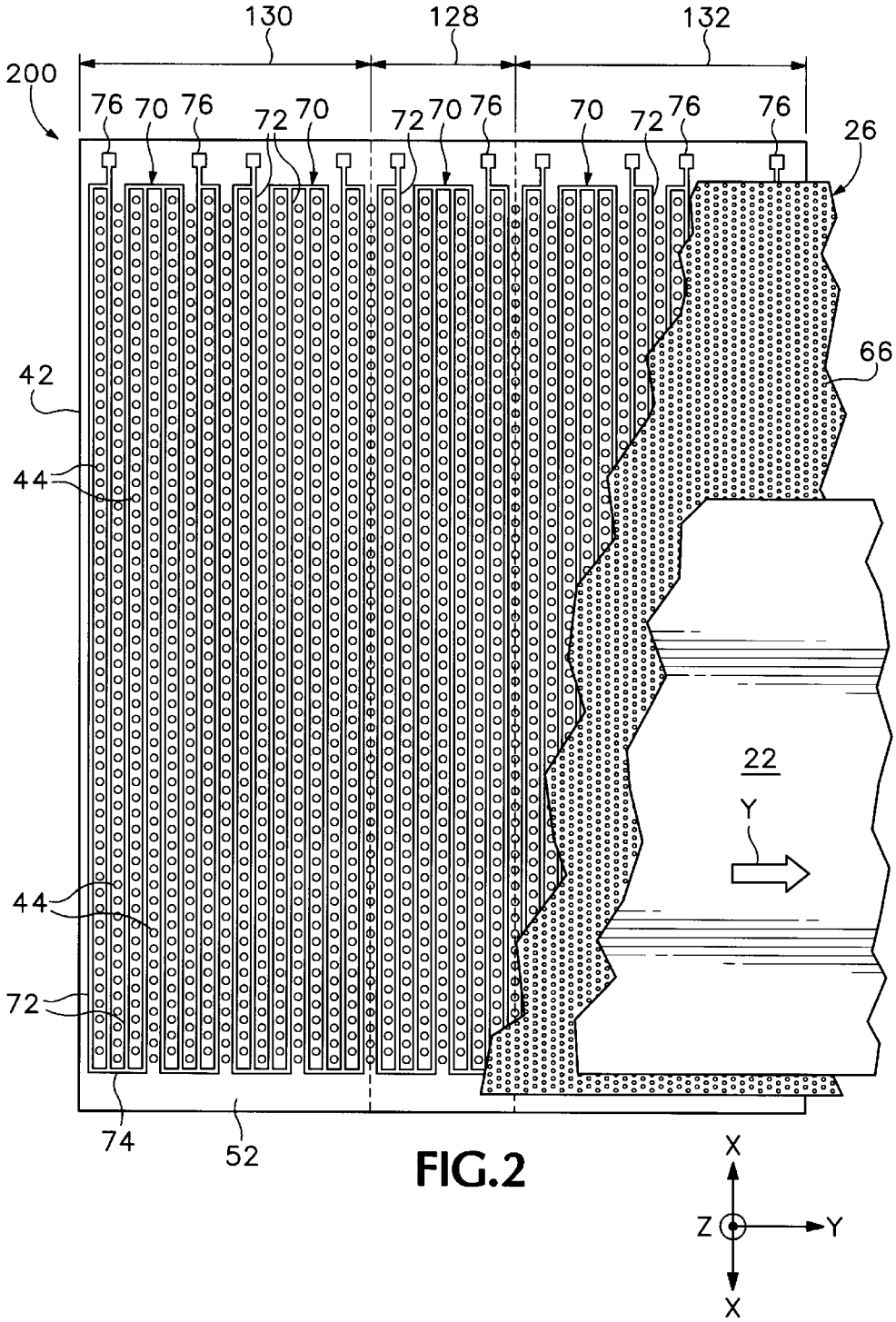
FIG. 2 is a schematic illustration in a planar view (top) of a heated platen and vacuum belt assembly for the apparatus as shown in FIGS. 1A and 1B.
Figure 3:
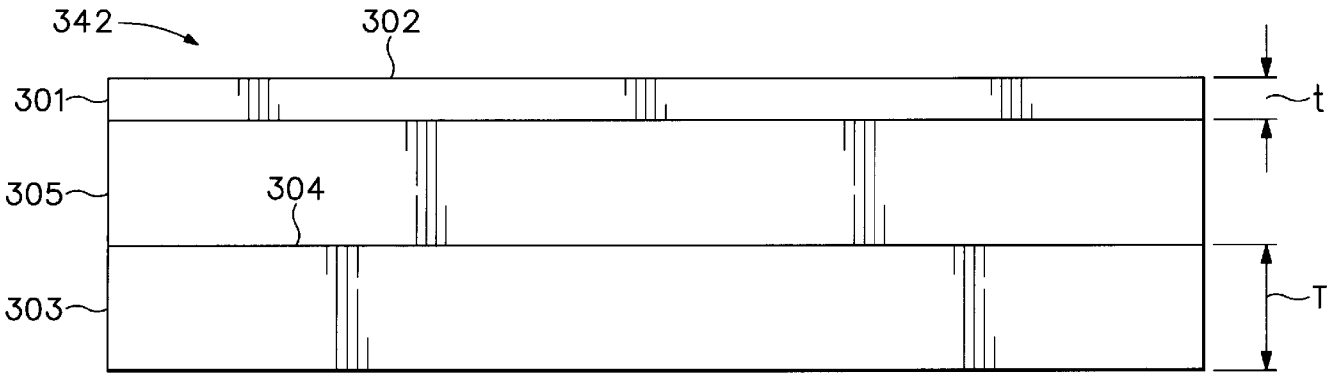
FIG. 3 is a schematic illustration in elevation view of an embodiment of a platen assembly in accordance with the present invention.

FIG. 3 is a schema tic of a non-warping heated platen assembly 342 in accordance with the present invention. The construct of the assembly 342 is composed of a relatively thin heater 301, having e.g., a thickness "t" in the range of 0.5–5.0 millimeters (mm). [Element 301 is analogous to elements 42/52/7076 of FIG. 2, but it will be recognized by those skilled in the art that specific dimensions are often unique to particular implementations and therefore relative. Therefore, examples given here are related to the state of the art as currently understood by the inventors to provide best mode preferences accordingly. Specific implementations may vary but remain within the scope of the invention as defined by the claims hereinbelow. The heater 301 ha s a heating surface 302 (analogous to FIG. 2, element 52) that will be in contact with the print media—where the media is transported by traditional mechanisms such as rollers coupled to stepper motors—or with the under-surface of a vacuum transport belt 26 (FIGS. 1A–1B).

The heater 301 is mounted to a relatively thick, rigid, platen base 303. The platen base 303 needs to be a construct that will remain flat when the heater 301 expands, contracts, and attempts to warp, placing a load on the base 303. The platen bas e 303 is relatively thick in comparison to the heater 301, e.g., having a thickness approximately 10 to 25 times that of the heater (5.0 to 25 mm). The platen base 303 should have a mounting surface 304 that is substantially planar, e.g., 70 microns. The platen base 303 should be of a material that is stiff, e.g., having a modulus of rigidity higher than approximately $2\times10^6$ pounds per square inch (psi). The base 303 is fabricated of a material having a modulus of elasticity in the approximate range of $5\times10^6$ psi to $50\times10^6$ psi. The platen base 303 should also be constructed of a material having a high thermal conductivity characteristic of at least approximately 50W/M° K. Moreover, the platen base 303 should also be constructed of a material having a low coefficient of thermal expansion (CTE) of approximately $30\times10^{-6}$ mm/mm° K or less. Therefore, preferred materials of aluminum, magnesium, and silicon carbide metal matrix compositions have been found to be among the best suited for use as a platen base 303 in accordance with the present invention.

With the base 303 being relatively thick with respect to the heater assembly 301, and having very low lateral thermal resistance, this assembly 342 provides a nearly isothermal base without thermal stresses. If the base 303 has a very low coefficient of thermal expansion ("CTE"), less than $5\times10^{-6}$ mm/mmK, it can have a lower thermal conductivity and be less close to an isothermal state while retaining its flatness.

Regardless of the material employed, the intent is to provide a thermally stable platen base 303 regardless of temperature profiles, excursions, or transients the heater 301 is subjected to between warm-up and cool-down cycles. In other words, the relatively thick, thermally conductive platen base 303 will heat-up uniformly and not warp itself to any effective degree due to varying thermal expansions and contractions.

The heater 301 is affixed to the platen base 303 in a constrained manner that the z-dimension between the two is tightly controlled. The attachment 305 is a construct that comprises a mechanism providing high thermal resistance between the heater 301 and the platen base 303, substantially limiting the thermal transfer between the two. In addition for helping maintain the flatness of the assembly 342, particularly that of the media contact surface 302, a high thermal resistance assists in keeping the transient response times to a minimum. Thermal resistivity of the attachment 305, for example, of at least 0.04 $Km^2/W$ is preferred. Specific exemplary embodiments of the constraining attachment 305 are detailed hereinafter.

However, it can now be recognized that because the platen base 303 is flat, stiff, and substantially non-warping in response to thermal excursions thereof and because the heater 301 is tightly constrained to the platen base mounting surface 304 in the z-axis direction, the platen contact surface 302 warps only within predetermined tolerances in the Z-direction (e.g., 100 um) throughout the heater 301 operational range (e.g., 0° C. to 150° C.).

Figure 4:
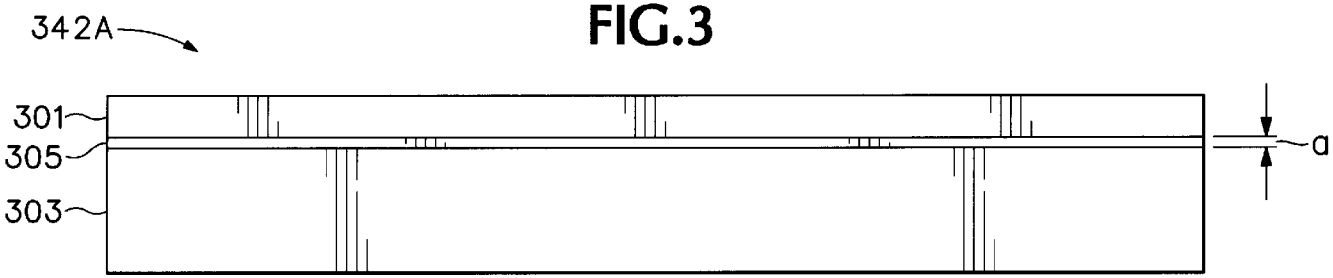
FIG. 4 is a schematic illustration in elevation view of a first alternative embodiment of a platen assembly in accordance with the present invention.

FIG. 4 is a schematic illustration of an embodiment of the non-warping heated platen 342A construct of the present invention in which the attachment 305 construct comprises a relatively thin (dimension "a") adhesive layer, e.g., approximately 0.1 mm to 0.2 mm for a respective heater 301 having a thickness "t" in the approximate range of 0.5 to 5.0 mm and a platen base 303 having a thickness "T" in the approximate range of 5.0 to 25 mm as shown in FIG. 3. The adhesive is chosen from those materials having a high allowable percentage elongation property (%EP, for example approximately 500%) and a low shear modulus ("G"), in the approximate range of 100 to 500 psi, such that the adhesive layer attachment 305 can also absorb mismatches in CTE between the heater 301 and the base 303 while not transferring shear loads to the base. Exemplary adhesives suited for use in accordance with the present invention include type 9885 by 3M, St. Paul, Minn., having an elongation property of at least about 500%, allowing the mismatch in CTE between the heater 301 and base 303 and shear modulus of about 100 psi (note, however, has a very low insulation value); BONDPLY™ 100, manufactured by Berquist company of Minneapolis, Minn., having an elongation property of approximately 500% and a low shear modulus (note, however, this material may be problematical a continuous operations at temperatures greater than or equal to about 120° C.).

Because the adhesive layer attachment 305 can withstand the relative large %EP, relatively thin layers can absorb the mismatch in CTE between the heater 301 and platen base 303. Because the adhesive layer attachment 305 is relatively thin, the tolerance that are defined as a percentage of the adhesive thickness are kept small, e.g., about 0.0005-inch. This is important because the adhesive may be in the pen-to-paper spacing (PPS) tolerance stack-up. Because the adhesive layer attachment 305 has a low shear modulus, mismatch in CTE between the heater 301 and the base 303 will not allow significant platen 342A warping.

Figure 5:
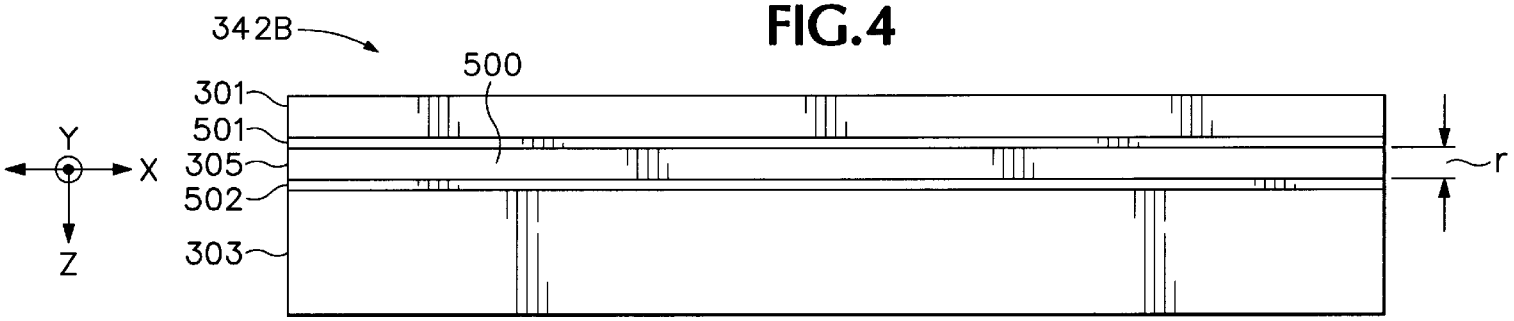
FIG. 5 is a schematic illustration in elevation view of a second alternative embodiment of a platen assembly in accordance with the present invention.

FIG. 5 is another embodiment for a non-warping heated platen 342B in accordance with the present invention. The heater 301 to platen base 303 attachment 305 is a construct including a rubber material 500 sandwiched with adhesive layers 501, 502 on its surfaces adjacent the heater 301 and base 303, respectively. A rubber attachment 305 construct allows the heater 301 to expand and contract freely, keeping heater element stresses low. Moreover, a rubber attachment 305 construct minimizes the needed stiffness and thickness of the platen base 303. The gasket-like structure of heater-rubber attachment-base has the benefit of no sliding joints or attachment areas that may wear or stick.

Rubber materials such as silicon, ethylene-propylene-diene monomer ("EPDM") blends, and perfluoro elastomers have relatively poor thermal conductivity—in the approximate range of 0.1 to 0.3 W/mK. Thus, such rubber materials act as a thermal insulation between the heater 301 and platen base 303. This will allow the heater 301 to warm-up rapidly with minimal heat loss to the base 303. Moreover, these rubber materials have a very low shear modulus: silicon=95 psi, EPDM=210 psi, and perfluoro elastomers=230 psi.

The rubber attachment 305 construct will allow the heater 301 to expand and contract with minimal shearing loads transferred to the platen base 303. Choosing the correct thickness is a matter of specific implementation; for the exemplary ranges of t=0.5–5.0 mm and T=5.0–25 mm, a range of rubber thickness, "r," of approximately 1.0 mm to 3.0 mm is generally preferred.

The rubber material preferred should have a tensile modulus in the range of at least 250 psi such that it will be stiff enough to hold the heater 301 flat when it tries to warp relative to the platen base 303. The rubber materials listed hereinbefore fall within this range and are therefore preferred.

The adhesive layers 501, 502 should be selected from adhesive materials such that it can be applied to a very tight thickness tolerance to provided structural integrity in the z-axis direction. Acrylic and silicone adhesives are preferred.

A specific implementation choice of rubber material and thickness will cause shearing loads transmitted to the platen base 303 to be small enough not to cause the base to deflect beyond the flatness target limit of 100 um. In other words, since rubber is very flexible, any thermal warping stresses in it will not lead to significant deflections since the base 303 material is so much stiffer.

Figure 6A:
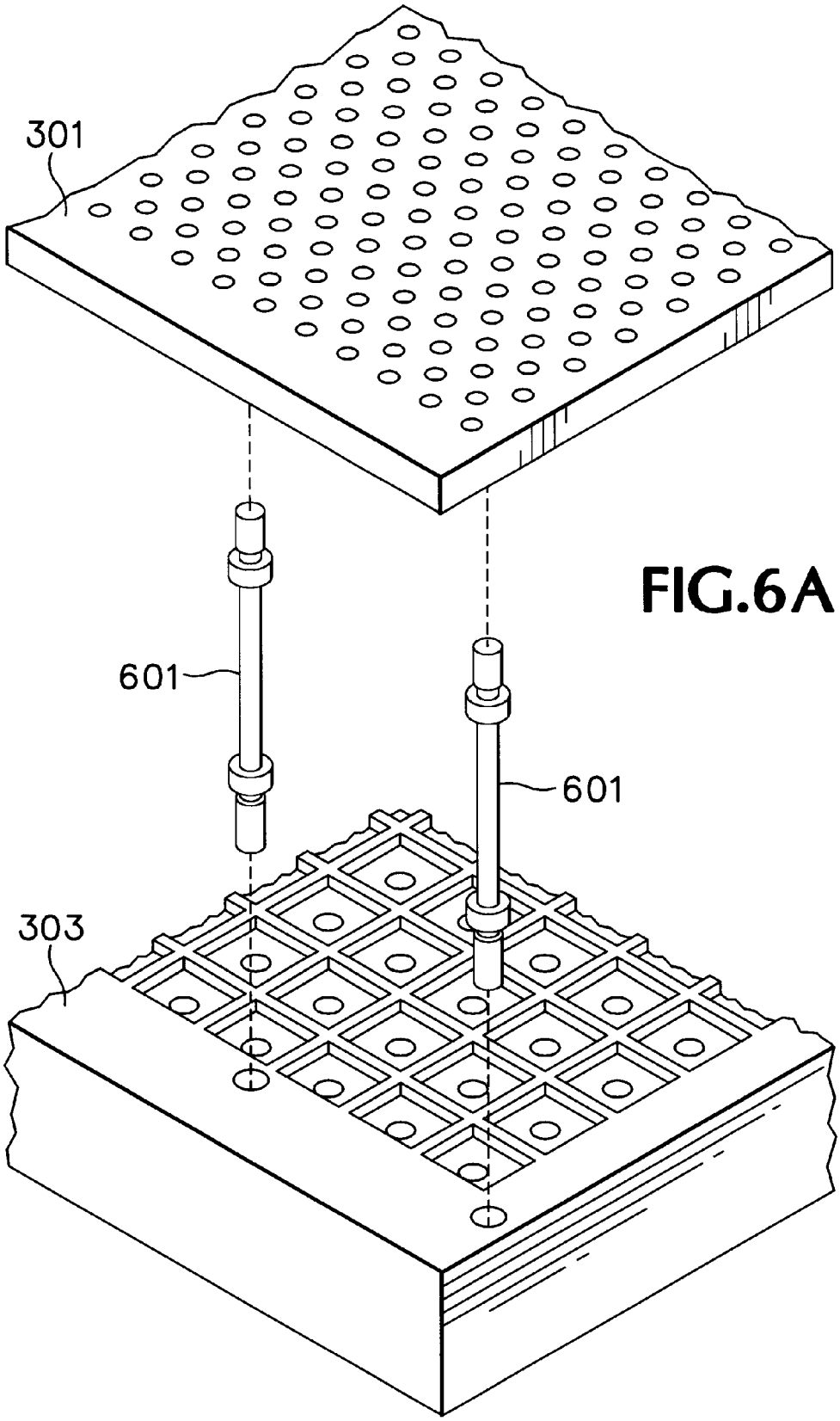
FIGS. 6A, 6B and 6C are schematic illustrations of a third alternative embodiment of a platen assembly in accordance with the present invention.
Figure 6B:
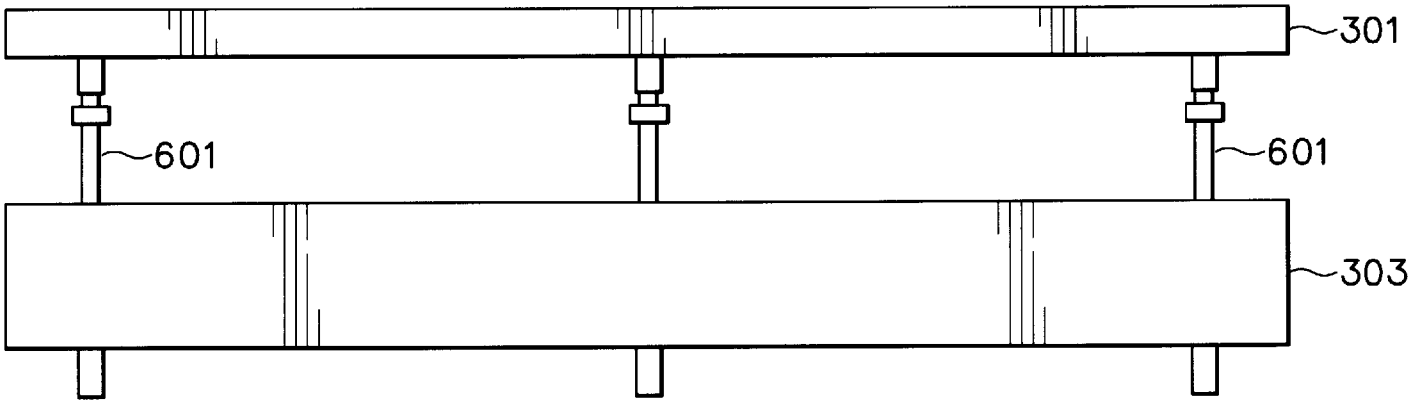
Figure 6C:
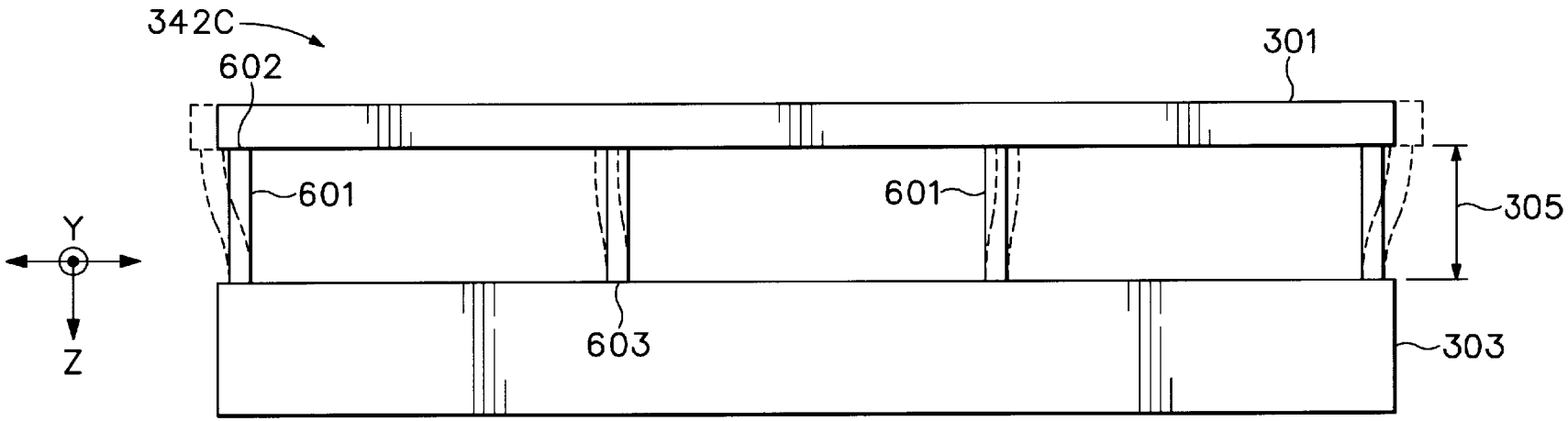

FIGS. 6A, 6B and 6C show another alternative embodiment of a non-warping heated platen 342C in accordance with the present invention. The method of attachment 305 in this embodiment is provided using a plurality of flexible standoffs 601. Each flexible standoff 601 is attached fixedly to the heater 301 on one standoff end 602 and to the platen base 303 on the other standoff end 603. Each standoff 601 is identical, fabricated of a relatively stiff material (e.g., approximately $10\times10^6$ psi to $27.5\times10^6$ psi) and has a high aspect ratio in the z-axis. The number of standoffs 601 and the aspect ratio are selected for a specific implementation such that as the heater 301 expands and contracts, the standoffs are easily deflected (illustrated by phantom line representations) without transmitting large loads to the platen base 303 which would cause warping beyond the predetermined flatness tolerance limits. The standoffs 601 should have tight tolerances in the z-direction so that the heater 301 is held at a very constant distance away from the platen base 303 regardless of heater temperature.

Since the standoffs 601 are stiff in their z-axial length, they can hold the heater 301 flat as it tries to warp relative to the platen base 303. As an example, thirty standoffs 601 made of titanium having an aspect ratio of approximately 10:1 can be employed in accordance with the present invention.

Since the standoffs 601 have a relatively very small cross-sectional area, very little heat is transferred from the heater 301 to the platen base 303, particularly when highly conductive fabrication materials—such as aluminum and copper—are not employed. This will allow the heater 301 to rapidly warm-up with minimal heat loss to the base 303.

Parts or adhesives needed for attachment should be selected and so that they provide a very weak thermal conduction path between the heater 301 and platen base 303. These other parts should be designed so that they do not significantly warp due to temperature gradients throughout the heater 301 operational range which would cause the base 303 to warp beyond acceptable limits.

Some advantages to the use of standoffs 601 are: they allow the heater 301 to freely expand and contract, keeping heater stresses low compared to embodiments where the heater is directly attached to the platen base 303; they minimize the needed stiffness and thickness of the base 303; they take up little space and have minimal contact with the heater 301, allowing room for other piece parts—such as heat pipes, insulation and gaskets—subjacent the heater; they provide ease of assembly; they r educe the number of critical tolerances for the attachment 305; and they eliminate de-lamination type failures that can occur when the heater 301 is attached to the base 303 with adhesives.

Figure 7:
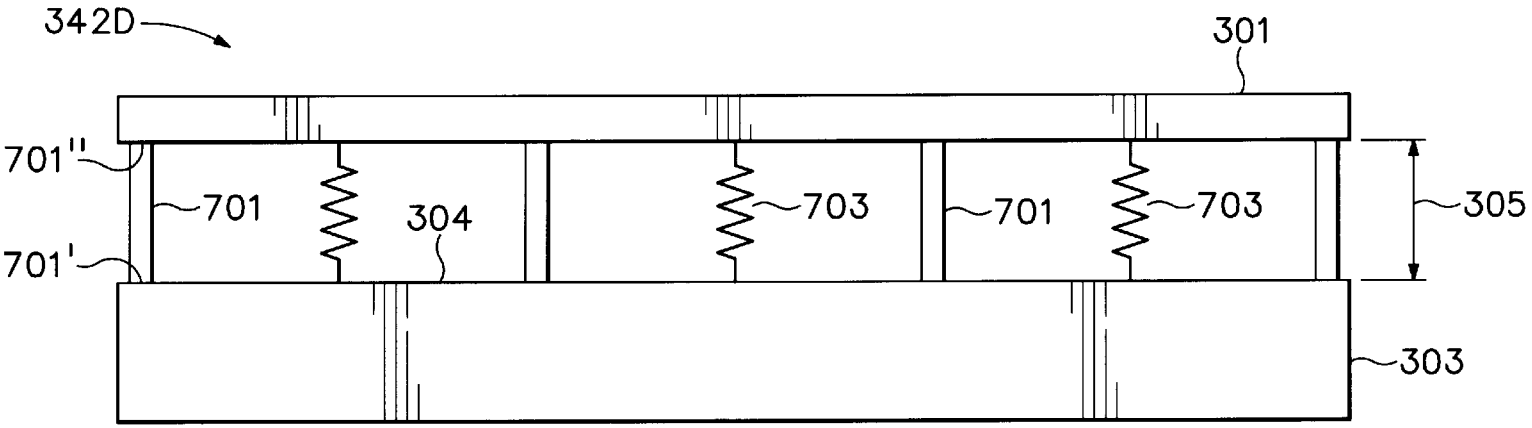
FIG. 7 is a schematic illustration in elevation view of a fourth alternative embodiment of a platen assembly in accordance with the present invention.

FIG. 7 illustrates another embodiment for a non-warping heated platen 342D in accordance with the present invention. Again, as in FIGS. 6A–6C, standoffs are provided; however, in this embodiment the standoffs comprise rigid standoff posts 701 that are firmly attached at their interface end 701' with the platen base 303 but are slidingly mated at their heater interface ends 701". As with the FIGS. 6A–6C standoff 601 embodiment, the tolerance allowed each post 701 in the z-direction is used to determine the relative flatness of the heater 301. Tensile springs 703, or a like bias, connect the base 303 and the heater 301 and are used to maintain their relative positions in the platen 342D assembly. The spring load should be large enough to keep the heater 301 in contact with the posts 701 yet low enough to allow sliding in the x-axis relative thereto. This provides a means for the heater 301 to move during heating and cooling cycles, yet induces minimal load to the standoff posts 701 that is in turn transmitted to the base 303.

The standoff posts 701 are of a high aspect ratio; having a small cross-sectional area means that very little heat is transferred from the heater 301 to the platen base 303 through the standoff posts. High thermal conductivity materials such as aluminum and copper should thus be avoided for fabricating the posts 701. This construction allows the heater 301 to warm-up with minimal heat loss to the base 303.

The springs 703 provide a controllable mechanism for coupling whereby the heater 301 can freely expand and contract and yet the stress forces between the heater and base platen 303 are very low compared to the rigidity of the direct attachment embodiments. This removal of structural constraints minimizes the needed stiffness and thickness of the base 303 and the possibility of direct mounting delaminating failures are eliminated.

Again as in the embodiment shown in FIGS. 6A–6C, a relatively large air gap between the heater 301 and the platen base 303 provides insulation, reducing any heat transfer between the two. Other parts used—such as insulation, air channel labyrinths, gaskets and the like for attaching the standoff posts 701 to the base 303 surface 304—should be selected and so that they provide a very weak thermal conduction path between the heater 301 and base 303. These other parts should be designed so that they do not significantly warp due to temperature gradients throughout the heater 301 operational range which would cause the base 303 to warp beyond acceptable limits.

Figure 8:
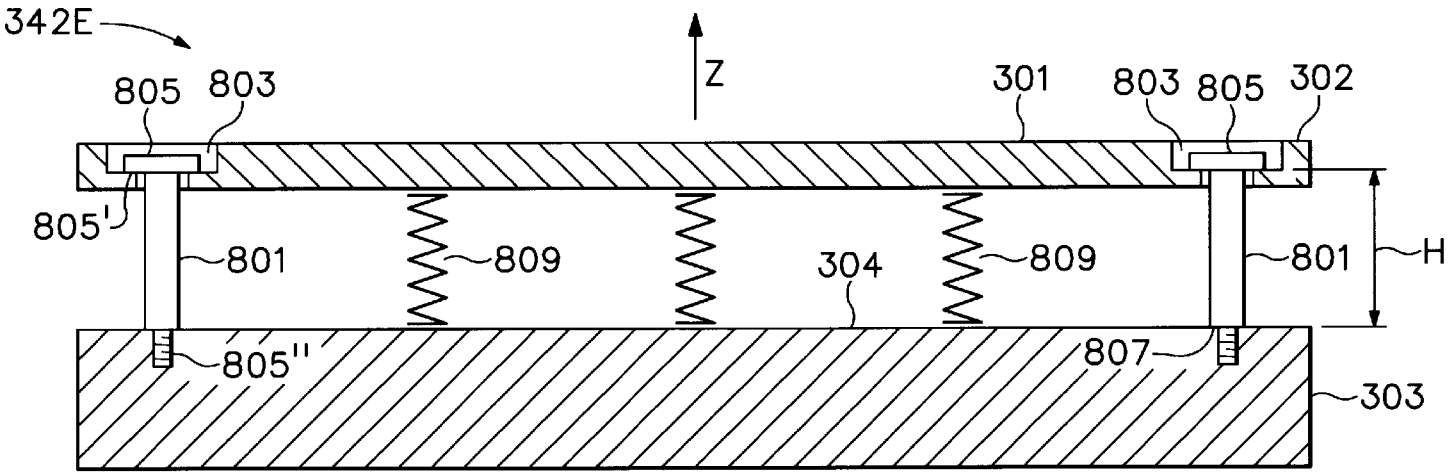
FIG. 8 is a schematic illustration in elevation view of a fifth alternative embodiment of a platen assembly in accordance with the present invention.

FIG. 8 illustrates another embodiment of a non-warping heated platen 342E assembly using shoulder bolts 801 and slotted apertures 803. Each shoulder bolt 801 has a low profile head 805 captured in the slotted apertures 803 of the heater 301. The shank of each bolt 801 passes through an oversized gap in the floor of a respective aperture 803 with a clearance for permitting expansion and contraction of the heater 301. The head 805 is recessed below the upper surface 302 of the heater 301 in a non-interference fit in each aperture 803, providing room on each side of the head 805 whereby contraction and expansion of the heater 301 is permitted. The shoulder 807 of each bolt 801 is firmly mated to the surface 304 of the platen base 303 such as by providing threaded holes in the surface for receiving a bolt treaded tip 805" therein. Compression springs 809, or like bias, are provided between the heater 301 and platen base 303 to hold the heater assembly against the bottom 805' of the bolt head 805, permitting sliding within the aperture 803 as the heater expands and contracts during operational cycles. The spring load should be large enough to keep the heater 301 in contact with the head bottom 805' surface yet low enough to allow the permitted motion within the aperture 803. Minimal loads are transferred to the bolts 801 that could be in turn transmitted to the base 303.

The bolts 801 are given a high aspect ratio such that very little heat is transferred from the heater 301 to the platen base 303 therethrough. High thermal conductivity materials such as aluminum and copper should thus be avoided for fabricating the bolts 801. This allows the heater assembly to rapidly warm-up with minimal heat loss through the bolts.

As with the standoff 601 of FIGS. 6A–6C and the standoff posts 701 of FIG. 7, the bolt's z-axis height ("H") tolerance controls the relative flatness of the heater 301.

Again as in the embodiments illustrated by FIGS. 6 and 7, a relatively large air gap between the heater 301 and the platen base 303 provides insulation, reducing any heat transfer between the two. Other parts used in the air gap region—such as insulation, air channel labyrinths, gaskets and the like should be selected and so that they provide a very weak thermal conduction path between the heater 301 and base 303. These other parts should be designed so that they do not significantly warp due to temperature gradients throughout the heater 301 operational range which would cause the base 303 to warp beyond acceptable limits.

The use of shoulder bolts 801 in heater apertures 803 keeps the heater 301 and platen base 303 stresses low compared to a direct contact interface, eliminating delaminating failures as may occur therein. It also minimizes the needed stiffness and thickness of the base 303. The embodiment of FIG. 8 also has the advantage of ease of assembly.

Thus, the present invention provides a non-warping heated platen 342, 342A–E that uses tight controls 305 in the axial direction (z) between a planar heater 301 used to heat print media 22 passing thereacross and a rigid planar base 303 to which it is coupled.

The foregoing description of the preferred embodiment of the present invention has been presented for purposes of illustration and description. It is not intended to be exhaustive or to limit the invention to the precise form or to exemplary embodiments disclosed. Many modifications and variations will be apparent to practitioners skilled in this art. Similarly, any process steps described might be interchangeable with other steps in order to achieve the same result. The disclosed embodiment was chosen and described in order to best explain the principles of the invention and its best mode practical or preferred application, thereby to enable others skilled in the art to understand the invention for various embodiments and with various modifications as are suited to the particular use or implementation contemplated. It is intended that the scope of the invention be defined by the following claims and there equivalents. Reference to an element in the singular is not intended to mean "one and only one" unless explicitly so stated, but can mean "one or more." Moreover, no element, component, nor method step in the present disclosure is intended to be dedicated to the public regardless of whether the element, component, or method step is explicitly recited in the claims. No claim element herein is to be construed under the provisions of 35 U.S.C. Sec. 112, sixth paragraph, unless the element is expressly recited using the phrase "means for. . . ."

What is claimed is:

1. A heated platen apparatus, having a media transport surface, comprising:

a planar heater, forming said surface and having a predetermined thickness "t";

a planar base, having a predetermined thickness "T," substantially greater than "t," and having a low coefficient of thermal expansion; and an attachment conjoining said heater and said base, wherein the attachment provides a high thermal resistance and said surface remains planar regardless of temperature changes of said heater.

2. The apparatus as set forth in claim 1 comprising:

the planar base is flat, rigid, and substantially non-warping in response to thermal excursions thereof throughout the heater operational range by having a mounting surface that warps only within predetermined tolerances in an axial direction between the heater and base, and the heater is tightly constrained to a planar base mounting surface in the axial direction via the attachment.

3. The apparatus as set forth in claim 2 comprising:

the attachment is a construct such that only a relatively small mass must be heated before printing on a print medium on said surface.

4. The apparatus as set forth in claim 1 comprising:

said planar base is constructed of a thermally stable material wherein said planar base remains planar regardless of temperature profiles, excursions and transients of the heater and resultant heat transfers from the attachment.

5. The apparatus as set forth in claim 1 comprising:

the heater is affixed to the planar base via the attachment in a constrained manner such that distance between the two is controlled to a predetermined tolerance.

6. The apparatus as set forth in claim 1 comprising:

the attachment is a construct that comprises a mechanism providing high thermal resistance between the heater and the planar base.

7. The apparatus as set forth in claim 1 comprising:

thermal resistivity of the attachment is greater than 0.02 $Km^2/W$.

8. The apparatus as set forth in claim 1 comprising:

the planar base is fabricated of a material having a modulus of elasticity in the approximate range of $5\times10^6$ psi to $50\times10^6$ psi.

9. The apparatus as set forth in claim 1 comprising:

the planar base is relatively thick in comparison to the heater, having a thickness approximately ten to twenty-five times the thickness of the heater.

10. The apparatus as set forth in claim 1 comprising:

the planar base has a mounting surface that is substantially planar to within approximately two hundred microns when said base is maintained within a predetermined temperature range.

11. The apparatus as set forth in claim 1, the attachment comprising:

an adhesive chosen from those materials having a relatively high allowable percentage elongation property and a relatively low shear modulus in the approximate range of one hundred psi to five hundred psi and wherein said adhesive absorbs effects of mismatches in coefficients of thermal expansion between the heater and the planar base while not transferring shear loads to the base.

12. The apparatus as set forth in claim 11, comprising:

the adhesive layer attachment is relatively thin in comparison to said planar heater dimension "t."

13. The apparatus as set forth in claim 1, the attachment comprising:

a plurality of flexible standoffs coupling the heater and the base, wherein flexure of the standoffs during temperature excursions is such that said heater remains planar regardless of said flexure.

14. The apparatus as set forth in claim 1, the attachment comprising:

a plurality of rigid standoffs coupling the heater and the base, wherein said heater is biasingly mounted in sliding engagement with a proximate end of said standoffs and said base is fixedly mounted to a distal end.

15. The apparatus as set forth in claim 1, the attachment comprising:

a plurality of shoulder bolts having a shoulder fixedly mounted to said base, said heater having a plurality of slotted apertures arrayed such that each aperture is receiving a bolt head in sliding engagement with a bottom surface of the respective aperture with said bolt head in a recess below a level of said transport surface, and a compressive bias for holding said heater against said bottom surface.

16. The apparatus as set forth in claim 1, the attachment comprising:

a rubber sheet fixedly sandwiched between said planar heater and said planar base.

17. A hard copy apparatus, having a means for transporting media through a printing zone, comprising:

a heated, planar, media platen located at least partially within said printing zone, having a planar platen member having a media heating surface, a rigid, planar base, and an attachment for coupling the platen member to the planar base, wherein the base is thermally conductive and relatively thicker than the platen member such that the base heats-up uniformly and does not warp itself to any effective degree due to varying thermal expansions and contractions of the platen member and thereby maintains planarity of the platen member.

18. The apparatus as set forth in claim 17, the attachment comprising:

a construct having controllable tolerances in an axial direction of coupling the platen member to the base such that said tolerances are maintained throughout temperature excursions of the platen member.

19. The apparatus as set forth in claim 17, the attachment comprising:

a construct holding the platen member to the base such that the attachment and base do not warp beyond predetermined limits due to temperature gradients throughout a predetermined operational range of the platen member.

20. The apparatus as set forth in claim 17, comprising:

said platen is a construct wherein only a relatively small thermal mass is heated prior to printing.

21. A method for maintaining planarity of a heated platen assembly of a printing apparatus, comprising the steps of:

providing a heated platen, an attaching member, and a rigid base;

fabricating an attaching member having operational characteristics of the attaching member to ensure flatness of the heated platen by requiring that only a small thermal mass must be heated before printing can begin; and coupling the platen and the base via the attaching member.

* * * * *